US005695621A

United States Patent [19]

Pop et al.

[11] Patent Number: 5,695,621

[45] Date of Patent: Dec. 9, 1997

[54] RESONATING ELECTROPLATING ANODE AND PROCESS

[75] Inventors: Mihai G. M. Pop; James E. Galford; Donald R. Stewart, all of Lynchburg, Va.

[73] Assignee: Framatome Technologies, Inc., Lynchburg, Va.

[21] Appl. No.: 688,907

[22] Filed: Jul. 31, 1996

[51] Int. Cl.[6] ..... C25B 11/00

[52] U.S. Cl. ..... 204/280; 204/222; 204/225

[58] Field of Search ..... 204/222, 225, 204/280

[56] References Cited

U.S. PATENT DOCUMENTS

| | | | |
|---|---|---|---|
| 2,431,949 | 12/1947 | Martz | 204/235 |
| 2,744,860 | 5/1956 | Rines | 204/45 |
| 3,252,881 | 5/1966 | Inoue | 204/222 |
| 3,351,539 | 11/1967 | Branson | 204/14 |
| 3,427,231 | 2/1969 | Schneider et al. | 204/3 |
| 3,567,604 | 3/1971 | Bodine | 204/222 |
| 3,804,725 | 4/1974 | Haynes | 204/26 |
| 4,019,969 | 4/1977 | Golebiowski et al. | 204/26 |
| 4,125,447 | 11/1978 | Bachert | 204/222 |
| 4,439,284 | 3/1984 | Walter | 204/43 |
| 4,572,773 | 2/1986 | Fallot | 204/222 |
| 4,624,750 | 11/1986 | Malagola et al. | 204/26 |
| 4,750,977 | 6/1988 | Marrese | 204/27 |
| 4,849,084 | 7/1989 | Vouzellaud | 204/224 |
| 5,391,290 | 2/1995 | Ichiba et al. | 205/140 |

*Primary Examiner*—Bruce F. Bell

*Attorney, Agent, or Firm*—Rhodes Coats & Bennett, L.L.P.

[57] ABSTRACT

A resonating electroplating anode electrode for electroplating the inside surfaces of steam generator tubing. The resonating electroplating anode electrode is formed from a plurality of tubular ceramic resonating material pieces glued to the inside and/or to one end of an anode tube to create a single resonating volume. In operation, an electrolyte solution is fed to the outside of the electrode in an annulus formed between the steam generator tube and the anode and returns through a hollow center in the anode. During use, the resonating materials resonate within the electrolyte solution during the electroplating process, thus creating an ultrasound enhanced-electroplating process. As a result, the resonating electroplating anode electrode and the resulting process reduce the amount of time required for electroplating, increase the production rate, reduce the residual internal stress resulting from electroplating, improves ductility and reduce brittleness of electrode-deposited nickel, produce a less porous deposited plating layer which improves corrosion resistance, and improve the uniformity of the electroplating coating grains. The resulting plated generator tubing is of superior quality and extended durability relative to currently known techniques.

35 Claims, 3 Drawing Sheets

RESONATING ELECTROPLATING ANODE AND PROCESS

BACKGROUND OF THE INVENTION (1) Field of the Invention

The present invention relates generally to electroplating the inner surface of steam generator tubing and, more particularly, to a resonating electroplating anode adapted to use ultrasonic energy to improve the electroplating process.

(2) Description of the Prior Art

Steam generators in nuclear reactors incorporate large bundles of tubing. When the steam generator is brought into operation, an adequate reactor coolant pressure boundary offered by the steam generator's tube bundle must be ensured. Generally, the integrity of the tube walls provides reasonable assurance that the steam generator tubing has adequate structural and leakage integrity to perform as designed. After some period of operation of the steam generator, sleeves may be used to repair defective steam generator tube portions and thus keep the tubes in service.

One of the accepted sleeve repair techniques calls for electroplating with nickel where areas of the tubes may be electroplated to form a qualified accepted repair for said tubes.

Current designs of electroplating anodes for use with steam generator tubing typically consist of a simple cylindrical non-consuming anode. The steam generator tubing acts as a cathode. The ions deposited on the inside of the steam generator tube during the electroplating process are supplied by a nickel salt solution circulated between the anode and the cathode.

The conventional electroplating process is slow, often taking 4.5 to 5.0 hours to both clean and electroplate a length of tubing. In addition, the electroplated tubing may have residual internal stresses, may be relatively porous, especially in the Watts substrate, can exhibit ductility changes based on voids or hydrogen inclusion inherent to this process, and has nickel grains of various sizes throughout the electroplating.

The electroplating process itself requires 3.5 to 4.0 hours for completion. This length of time is quite long considering the limited available outage time and the number of steam generator tubes which may need to be repaired.

Furthermore, various experiments have shown that the electroplating process produces internal stresses in the electroplated material. Numerous theories address this phenomenon. The most recognized theories include lattice misfit, co-deposition of hydrogen, crystallite-joining, dislocation development, excess energy and dehydration (Kushner theory). These theories are explained in more detail by T. K. Dennis and T. E. Such. *Nickel and Chromium Plating*, Third Edition, Woodhead Publishing Limited, Cambridge, England, 1993, pp. 190–194.

The electroplated material, in many operating conditions, may have smaller crystal elongations than the base material. It has been noted that the ductility of the tubing is reduced when the electroplated material has smaller elongations than the base material. The reduced ductility is attributed, by some authors, to the internal stress between nickel grains, and by other authors to co-deposition of hydrogen and the co-deposition of contaminating species. The authors discussing this reduced ductility include: R. L. Zeller, III and Uziel Landau. *The Effect of Hydrogen on the Ductility of Electrodeposited Ni-P Amorphous Alloys*—J. Electrochem. Soc., Vol. 137, No. 4, April 1990. The above works are hereby incorporated by reference in their entirety.

Also, depending on the method of applying an electric field during electroplating, the electrode-deposited nickel will often have a large variation in pore size and density. This phenomenon is easily viewed by scanning electron microphotograph images of the deposits.

Additionally, electrodeposited grain sizes can be quite non-uniform in the state-of-the-art nickel electroplating processes. This non-uniformity is due to electrical field dependence on numerous parameters including current cycling and solution chemistry, among others.

U.S. Pat. No. 4,624,750, issued to Malagola et al., discloses a process and device for corrosion protection of a steam generator tube. The device incorporates an upper plug and a lower plug having diameters permitting a generator tube to be plugged in a leak-tight manner. Two conduits pass through the lower plug, making it possible, respectively, to feed the electrolyte into the inner volume of the tube between the upper and lower plugs and to remove the electrolyte so that it can be collected in a storage vessel. The pump enables the electrolyte to travel from the storage vessel to the inner volume of the tube between the plugs. Adjustment of the composition of the electrolyte for nickel deposition can be made in the storage vessel.

In Malagola et al., a perforated tubular electrode having a diameter slightly smaller than the diameter of the steam generator tube is fixed on the lower plug. The tubular electrode is connected to a positive pole of a DC generator. The negative pole of the DC generator is connected to the steam generator tube. Devices embodying the Malagola et al. disclosure fail to overcome the problems of the prior art as discussed above. Specifically, the electroplating process is still very slow, the electroplated material continues to have residual internal stresses, is relatively porous, and in many operating conditions becomes less ductile than the base material, and has nickel grains of non-uniform size.

U.S. Pat. No. 4,849,084, issued to Vouzellaud, discloses a similar device incorporating a rod and a sealing device enabling part of the inside surface of a steam generator tube to be isolated from adjacent zones. The sealing device has two assemblies spaced along the length of the rod. Each assembly consists of an annular piston slidably mounted on the body of the rod, and at least one annular seal interposed between the piston and the radial support flange. Compressed air is supplied to the piston; thereby enabling the seal to be compressed and to undergo radial expansion. Vouzellaud does not improve or overcome the above-mentioned failings of the prior art associated with the speed and quality of the electroplating process.

Thus, there remains a need for a new and improved device and process for electroplating the inner surfaces of steam generator tubing which significantly decreases the amount of time necessary to clean and electroplate the tube surfaces while, at the same time, reduces residual internal stresses in the electroplating material, increases ductility, reduces the number and size of pores, or increases the uniformity in grain size of the electroplating deposits.

SUMMARY OF THE INVENTION

The present invention is directed to a resonating electroplating anode electrode for electroplating the inside surfaces of steam generator tubing. The invention consists of a resonating electroplating anode electrode formed from a number of tubular ceramic resonating material pieces. The resonating material pieces 14 are glued to the inside of an anode tube to create a single resonating volume. The resonating material pieces 14 may also be mounted at one end of the anode electrode. Other embodiments may include a combination of resonating pieces along the inside and mounted at one end of the anode tube.

In operation, an electrolyte solution is fed to the outside of the electrode in an annulus formed between the steam generator tube and the anode and returns through a hollow center in the anode. During use, the resonating materials resonate within the electrolyte solution during the electroplating process, thus creating an ultrasound enhanced-electroplating process. As a result, the resonating electroplating anode electrode and the resulting process reduce the amount of time required for electroplating, increase the production rate, reduce the residual internal stress resulting from electroplating, improve ductility, produce a less porous deposited plating layer which improves corrosion resistance, and improve the uniformity of electrodeposited grains which can be very non-uniform in the state-of-the-art electroplating processes. The resulting plated generator tubing is of superior quality and extended durability relative to currently known techniques.

Accordingly, one aspect of the present invention is to provide an electroplating resonating anode including: (a) a hollow anode having an interior surface; and (b) a resonator aligned along the interior surface of the anode, mounted at one end of the anode, or both.

Another aspect of the present invention is to provide a resonator for an electroplating anode having a hollow anode having an interior surface, the resonator including a ceramic resonator being aligned along the interior surface of the anode, mounted at one end of the anode, or both.

Still another aspect of the present invention is to provide an electroplating resonating anode including: (a) a hollow anode having an interior surface; (b) a ceramic resonator having an exterior surface aligned along the interior surface of the anode; and (c) a binder binding the exterior surface of the ceramic resonator to the interior surface of the anode.

These and other aspects of the present invention will become apparent to those skilled in the art after a reading of the following description of the preferred embodiment when considered with the drawings.

DESCRIPTION OF THE PREFERRED EMBODIMENTS

Figure 1A:
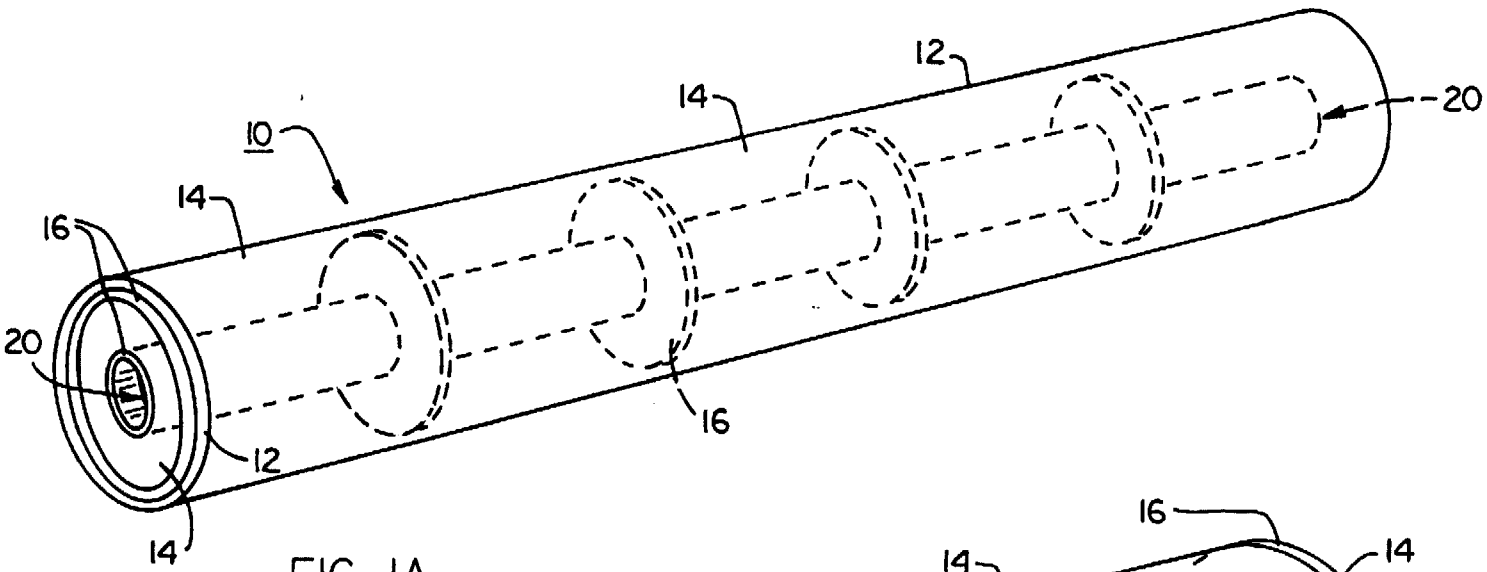
FIG. 1A illustrates a perspective view of one embodiment of a resonating electroplating anode constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1A in particular, it will be understood that the illustrations are for the purpose of describing a preferred embodiment of the invention and are not intended to limit the invention thereto. As best seen in FIG. 1A, a resonating electroplating anode electrode, generally designated 10, is shown constructed according to the present invention.

The resonating electroplating anode electrode 10 includes a plurality of tubular ceramic resonating material pieces 14. The dimensions of the resonating material pieces 14 relate to the frequency and the amount of ultrasonic energy added to the electroplating process. The resonating material pieces 14 are coupled together and attached to the inside of an anode tube 12, creating a single resonating volume. A polymer binder 16 is used to couple the resonating material pieces 14 together and against the interior wall of anode tube 12. The polymer binder 16 is specifically selected to withstand the high-cycle fatigue of ultrasonic resonating or vibrating and the corrosive nature of electrolyte solutions.

Figure 1B:
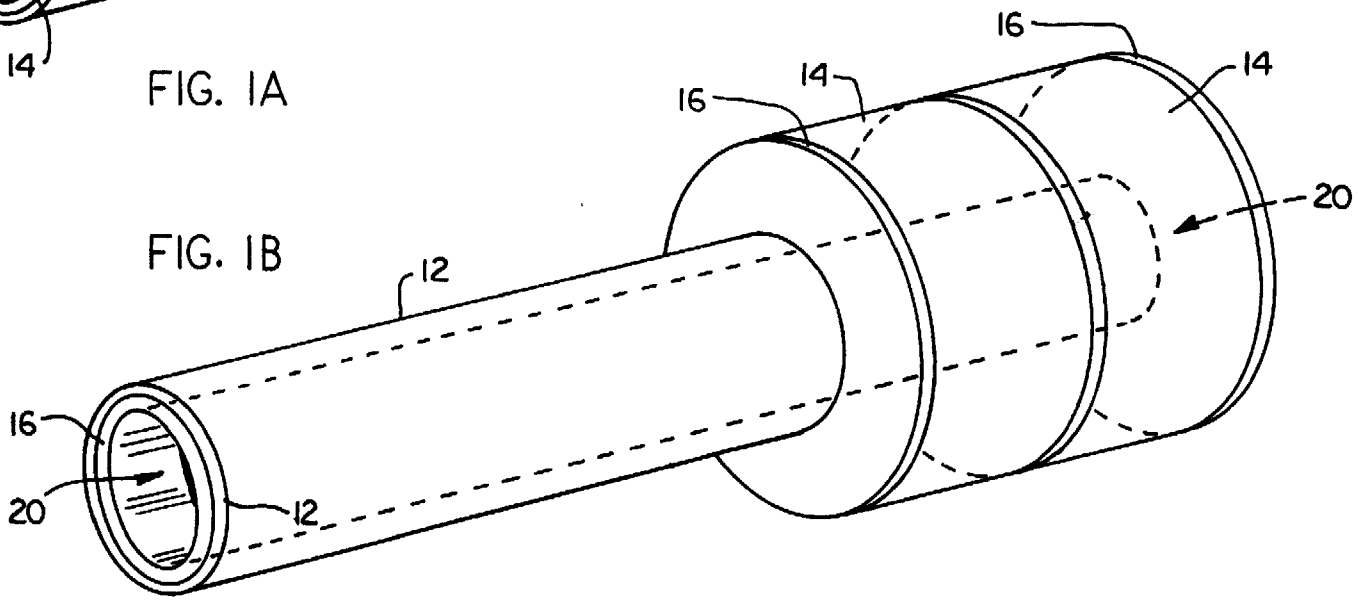
FIG. 1B illustrates a perspective view of a second embodiment of a resonating electroplating anode constructed according to the present invention.
Figure 1C:
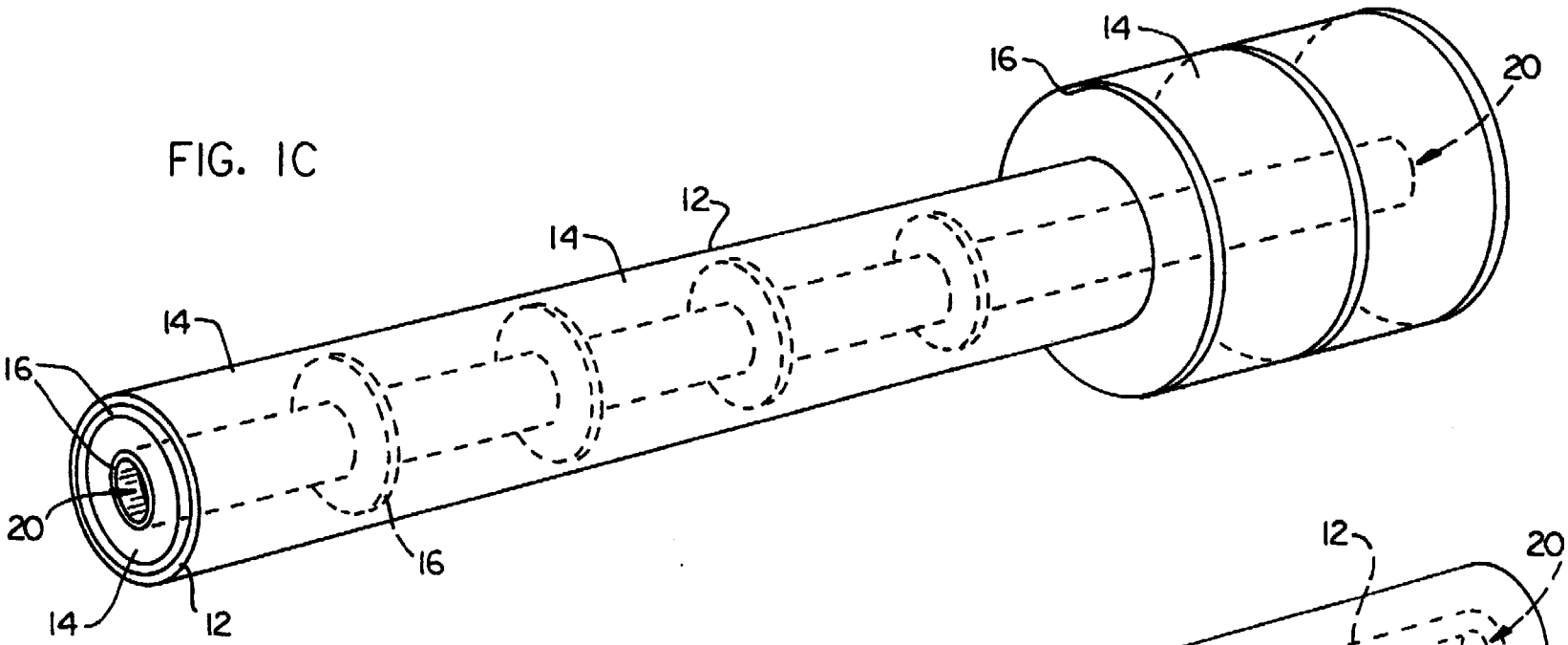
FIG. 1C illustrates a perspective view of a third embodiment of a resonating electroplating anode constructed according to the present invention.

The resonating material pieces 14 may also be mounted at one end of the anode tube 12 as shown in FIG. 1B with the binder 16. Additionally, a combination of the embodiments of FIGS. 1A and 1B may be used, wherein the resonating material pieces 14 are used along the inside and at one end of the anode tube 12 as shown in FIG. 1C.

The anode tube 12 is preferably platinum wrapped titanium. However, various materials such as multilayers of niobium and copper plated with platinum would be acceptable.

The anode tube 12 typically has a length of between about 4.0–12.0 inches and an outside diameter between about 0.190–0.50 inches. The preferred length is 8 inches and the preferred outside diameter is 0.255 inches. The anode tube 12 has a thickness of between about 0.060 inches—0.12 inches and is preferably 0.075 inches.

The ceramic resonators 14 are preferably selected from the group of ceramic materials consisting of lead zirconium titanate and barium titanate ceramic crystals. When ceramic crystals are used to form the resonators 14, the crystals are electrically connected. They are also bonded to the inside surface of the anode tube 12 with the binder 16 wherein the bound ceramic crystals and the anode tube 12 form a single resonating body. The ceramic resonators 14 are preferably concentrically aligned with the anode tube 12 being coupled together and attached to the inside of the anode tube and/or at one end of the anode tube 12 or a combination of both. The ceramic resonators 14 preferably have a hollow center or inner duct 20 along their axes. Also, in the preferred embodiment, the duct 20 is lined with another layer formed from the polymer binder 16. Other suitable material such as plastic or plastic tubing may be used to form an electrically isolating boundary.

The resonating electroplating anode electrode 10 may include multiple ceramic resonators 14 bound end-to-end linearly along the axis of the resonating electroplating anode electrode 10. The ceramic resonators have a length between about 0.4 inches to 4 inches, an outside diameter of between about 0.175 inches to 0.750 inches, and an inside diameter or duct 20 diameter of between about 0.080 inches to 0.350 inches.

The polymer binder 16 is preferably a dielectric polymeric glue selected from the group of epoxy resins. Other polymeric glues would be acceptable provided they have high volume resistivity, superior durability, thermal, mechanical shock and chemical resistance. The preferred polymeric binder 16 is a bi-component epoxy compound; has low viscosity; cures at room temperature; has exceptionally low after cure shrinkage, below 0.0002 inches/inch;

has high dimensional stability, preferably with a volume resistivity greater than $10^{14}$ ohms.centimeter; is an excellent electrical insulator; has superior durability; and has thermal, mechanical shock and chemical resistance.

Figure 2:
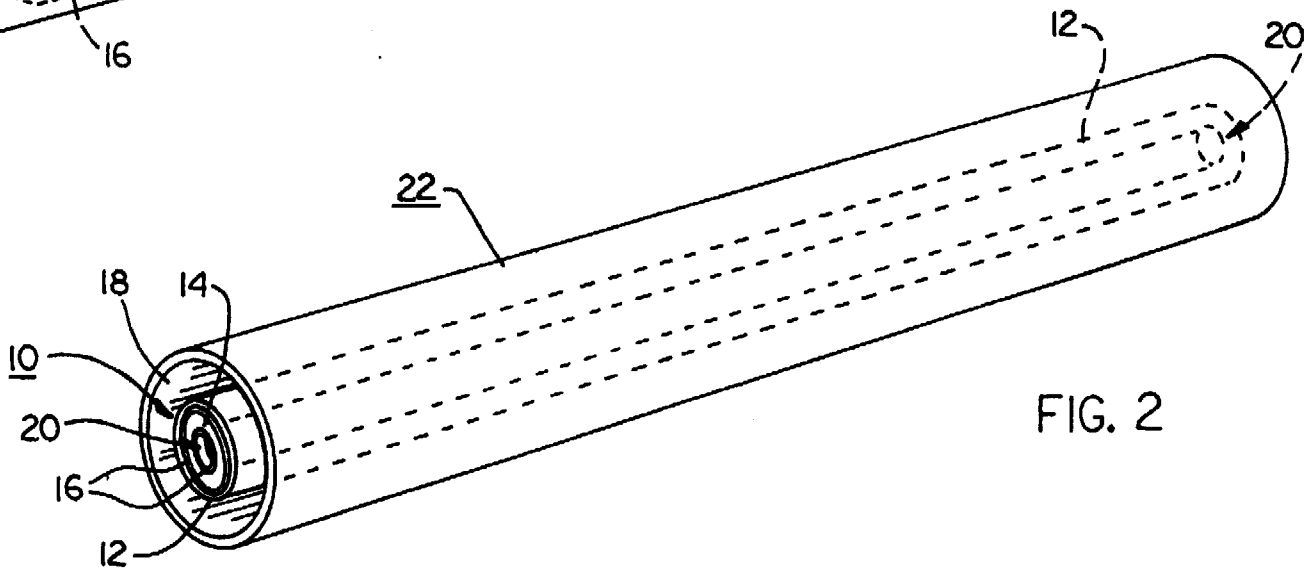
FIG. 2 illustrates the resonating electroplating anode positioned within a steam generator tube.

During operation, the resonating electroplating anode electrode 10 is inserted inside a steam generator tube 22, as shown in FIG. 2. The resonating electroplating anode electrode 10 and steam generator tube 22 form an annular chamber 18.

Figure 3:
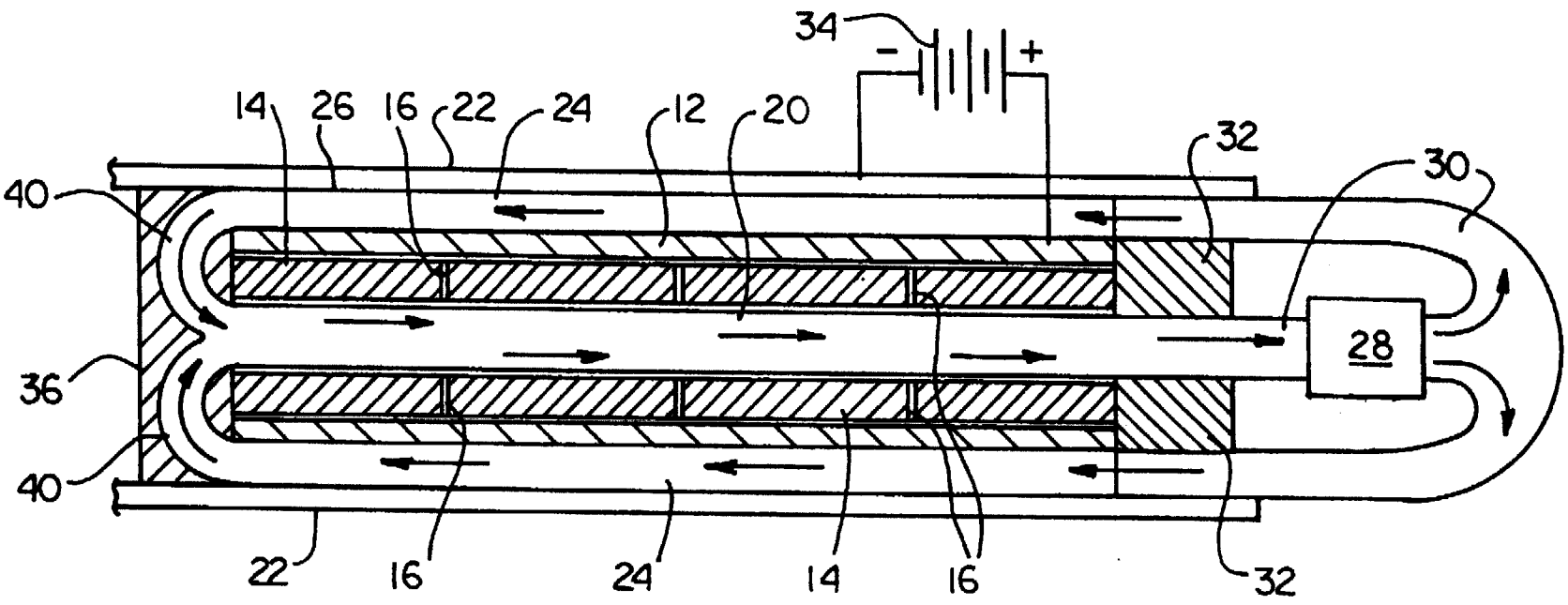
FIG. 3 illustrates a cross-section of the resonating electroplating anode shown in FIG. 2.

As best seen in FIG. 3, an electrolyte solution 24 is fed to the outside of the anode electrode 10 in the annular chamber 18 between the steam generator tube 22 and the anode electrode 10 and returns through the inner duct 20 of the anode electrode 10. The electrolyte solution is preferably a nickel salt solution. The plastic boundary layer is preferably a dielectric material such as polypropylene, polyethylene or Teflon. Other materials which exhibit suitable chemical, thermal and structural resistance would be acceptable.

A cross-section of the anode electrode 10 inside a steam generator tube 22 also shown in FIG. 3. A sealing member 36 having an electrolyte return channel 40 provides for sealing off a remainder of the steam generator tubing from an electrolyte solution 24. The electrolyte return channel 40 provides a flow path connecting the annular chamber 18 and the inner duct 20.

At an end of the anode opposite the sealing member 36, an electrolyte pump 28 pumps the electrolyte solution 24 into the annular chamber 18 and removes electrolyte from the inner duct 20 via pump conduit 30. The direction of flow of the electrolyte solution 24 is shown by "arrows" in annular chamber 18. However, reverse flow is equally acceptable.

The sealing member 36 confines the electrolyte solution 24 to the area within the steam generator tubing 22 requiring repair. Once the anode electrode 10, sealing member 36, electrolyte conduit 30 and electrolyte pump 28 are in place, the interior surface of the steam generator tube 22 is ready for the electroplating process.

The electroplating process utilizes electrolysis to deposit or reduce a metal onto the inside surface of the steam generator tubing 22. Electrolysis occurs by passing an electric current through an electrolytic solution 24. The electrolytic solution 24 may be an aqueous solution of some soluble compound. The preferred electrolyte is a nickel salt solution.

Electrolysis is accomplished by placing the positive terminal (anode) and the negative terminal (cathode) of a voltage source 34 in physical contact with the electrolyte solution 24. The anode electrode 10 is electrically connected to the positive terminal of the voltage source 34. The steam generator tubing 22 is electrically connected to the negative terminal (cathode) of the voltage source 34.

When a DC voltage is applied by the voltage source 34, negative ions in the electrolyte solution 24 are attracted to the anode electrode 10. When the negative ions reach the anode, they are oxidized. Positive ions in the electrolyte solution 24 are attracted to the cathode electrode which is the steam generator tube 22. The positive ions are reduced or deposited on the inside surface of the steam generator tube 22 to form a layer or coating.

When a nickel salt solution is used, the coating (electroplating) is formed of nickel. An electrolyte is a solution that may be partially or completely disassociated into positive and negative ions. These ions move under the influence of an electric potential such as a DC voltage. The movement of the ions produces an electric current.

Preferably, the pump system 28 continuously provides a fresh electrolyte into the annular chamber 18 and refreshes the electrolyte 24 after removal from the inner duct 20. Providing a fresh electrolyte increases the efficiency of the electroplating process.

In the preferred embodiment, the ceramic resonator 14 is resonated or vibrated using ultrasonic energy to enhance the electroplating process. The ultrasonic energy is supplied by an ultrasonic generator 32. The ultrasonic generator 32 is electrically coupled to the ceramic resonator 14 associated with the anode electrode 10. The ultrasonic generator 32 causes the ceramic resonator 14, and thus the anode electrode 10, to resonate within the electrolyte solution 24. Preferably, the ultrasonic energy provided to the resonator 14 has an intensity between 0.1 and 700 watts/$cm^2$ and a frequency within a range of 20 to 70 kHz.

The ultrasonic energy apparently increases the reorientation rate of water dipoles in the diffusion layer of the electroplating process and greatly assists the dehydration of nickel ions of the electrolyte solution 24 in the Helmoltz double layer zone of the process, therefore notably increasing deposition rates. Increasing deposition rates should significantly decrease the time required for electroplating—previously 3.5 to 4.0 hours—to between about 1.4 to 2.6 hours.

The use of ultrasonic energy during the electroplating process also appears to reduce the hydrogen incorporated in the deposit, thereby reducing lattice misfit; impedes the coalescence of crystallites during the growing process; helps transfer very rapidly the surface tension of a surface layer to the next surface layer as the deposit builds up; avoids the "freezing" of this tension in the lattice, which may be the origin of future dislocation development; and accelerates the dehydration of nickel ions in the Helmoltz double layer, thereby reducing the probability of water molecules remaining in contact with the nickel ions long enough to form oxides or hydroxides.

The use of ultrasonic energy during electroplating allows for hydrogen release during the process of ion migration to the growth point and ensures a contact with minimal internal stress at that growth point. This is commonly known as the Shaker effect.

When ultrasonic energy is introduced into the electroplating process (under specific conditions), a desirable "packing phenomena" has been observed. The nickel grains reduced or deposited on the steam generator tube 22 (cathode) are more tightly pressed together than would be expected normally. As the nickel grains are pressed together, the pore sizes and the number of pores is reduced. Reducing the number and size of pores in the plating process provides much greater protection against corrosion and brittleness. Furthermore, the use of ultrasonic energy during the electroplating process appears to provide a more uniform grain size.

Accordingly, the resonating electroplating anode electrode 10 and the resulting process created by mixing the ultrasonic energy (under specific conditions) with the electroplating electric field, increases the plating production rate, reduces the internal residual stress resulting from electroplating, improves ductility, reduces brittleness of the deposited nickel, produces a less porous nickel layer, improves corrosion resistance.

The resonating electroplating anode constructed according to the present invention is primarily designed for use in repairing tubes of nuclear steam generators; however, the anode may serve applications in other industrial processes where a high quality electroplated nickel coating is required. For example, the electrode described is suitable for applications where a nickel coating is applied inside an Inconel™ tube. The electrode also may be designed to apply metallic coating material on any form or shape of any type of material.

Certain modifications and improvements will occur to those skilled in the art upon a reading of the foregoing description; by way of example, the number and the dimensions of ceramic crystals and their relative position in the anode assembly. It should be understood that all such modifications and improvements have been deleted herein for the sake of conciseness and readability but are properly within the scope of the following claims.

We claim:

1. An electroplating resonating anode comprising:

(a) a hollow anode having an interior surface; and (b) a resonator aligned along said interior surface of said anode.

2. The anode according to claim 1 further including a binder binding said resonator to said interior surface of said anode.

3. The anode according to claim 2 wherein said binder is a polymeric binder.

4. The anode according to claim 3 wherein said binder is a corrosion resistant polymeric adhesive.

5. The anode according to claim 2 wherein said binder has shrinkage after cure less than about 0.0002 inches per inch.

6. The anode according to claim 2 wherein said binder is substantially dimensionally stable.

7. The anode according to claim 2 wherein said binder is thermal and mechanical shock resistant.

8. The anode according to claim 2 wherein said binder is chemically resistance to electrolytes.

9. The anode according to claim 2 wherein said binder has a volume resistivity greater than about $10^{14}$ ohm.centimeter.

10. The anode according to claim 1 wherein said anode is tubular.

11. The anode according to claim 10 wherein said anode is formed by binding ceramic crystals along on interior surface within said hollow anode tube with a polymeric binder, wherein said bound crystals and said anode tube form a single resonating body and said crystals are electrically connected.

12. The anode according to claim 10 wherein said tubular anode has a length and a diameter; said length being greater than said diameter.

13. The anode according to claim 10 wherein said tubular anode has a wall thickness between about 0.060 inches to 0.12 inches.

14. The anode according to claim 13 wherein said tubular anode has a wall thickness of about 0.075 inches.

15. The anode according to claim 10 wherein said tubular anode has an outside diameter between about 0.19 inches to 0.50 inches.

16. The anode according to claim 15 wherein said tubular anode has an outside diameter of about 0.255 inches.

17. The anode according to claim 1 wherein said anode material is electrically conductive, and is chemically resistant to the bath chemistry.

18. The anode according to claim 17 wherein said anode is formed from platinum wrapped titanium.

19. A resonator assembly for an electroplating anode having a hollow anode having an interior surface, said apparatus comprising: a ceramic resonator aligned along said interior surface of said anode.

20. The assembly according to claim 19 wherein said anode and said ceramic resonator are tubular.

21. The assembly according to claim 20 wherein said ceramic resonator is hollow and concentrically aligned along said interior surface of said tubular anode.

22. The assembly according to claim 19 wherein said ceramic resonator further includes an inner duct.

23. The assembly according to claim 22 further including a binder lining said interior duct of said ceramic resonator.

24. The assembly according to claim 22 wherein said ceramic resonators have an outside diameter between about 0.175 inches to 0.750 inches.

25. The assembly according to claim 24 wherein said inner duct of said ceramic resonator has an inside diameter no less than 0.08 inches.

26. The assembly according to claim 19 wherein said ceramic resonator is comprised of a plurality of ceramic segments.

27. The assembly according to claim 19 wherein said ceramic resonator is selected from the group consisting of lead zirconium titanate and barium titanate ceramic crystals.

28. An electroplating resonating anode comprising:

(a) a hollow anode having an interior surface;

(b) a ceramic resonator having an exterior surface aligned along said interior surface of said anode; and (c) a binder binding said exterior surface of said ceramic resonator to said interior surface of said anode.

29. The anode of claim 28 wherein said ceramic resonator is made of a plurality resonator sections bound together by said binder.

30. The anode of claim 28 wherein said ceramic resonator is made of a plurality of crystalline ceramic particles bound to each other and said anode with said binder, said bound crystalline ceramic particles and said anode tube forming a single resonating body.

31. An electroplating resonating anode comprising:

(a) a hollow anode having a through extending interior duct and an end;

(b) a ceramic resonator having a through extending interior duct; and (c) a binder binding said ceramic resonator to said anode wherein said ducts are aligned.

32. The anode of claim 31 wherein said ceramic resonator is made of a plurality resonator sections bound together by said binder.

33. The anode of claim 31 wherein said ceramic resonator is made of a plurality of crystalline ceramic particles bound to each other and said anode with said binder, said bound crystalline ceramic particles and said anode tube forming a resonating body.

34. The anode of claim 31 wherein said ceramic resonator is mounted at an end of said anode.

35. The anode of claim 31 wherein said ceramic resonator is mounted along said through extending duct of said anode.

* * * * *